US006458887B1

(12) United States Patent
Legros et al.

(10) Patent No.: US 6,458,887 B1
(45) Date of Patent: Oct. 1, 2002

(54) METHOD FOR PREPARING AN AQUEOUS POLYACRYLATE EMULSION FOR PROTECTING METAL SURFACE AGAINST CORROSION AND PRE-LUBRICATION THEREOF AND RESULTING EMULSION

(75) Inventors: Philippe Legros, Istres; Agnès Calleja, Croix Sainte Martigues; Yves Sully; Gérard Riess, both of Mulhouse, all of (FR)

(73) Assignee: Unisor, Puteaux (FR)

( * ) Notice: Subject to any disclaimer, the term of this patent is extended or adjusted under 35 U.S.C. 154(b) by 0 days.

(21) Appl. No.: 09/787,023

(22) PCT Filed: Sep. 9, 1999

(86) PCT No.: PCT/FR99/02142

§ 371 (c)(1),
(2), (4) Date: May 21, 2001

(87) PCT Pub. No.: WO00/15677

PCT Pub. Date: Mar. 23, 2000

(30) Foreign Application Priority Data

Sep. 14, 1998 (FR) ..... 98 11467

(51) Int. Cl.[7] ..... C08F 2/32; C08L 31/02; C08L 33/24; B65B 33/00; C23E 11/00

(52) U.S. Cl. ..... 524/801; 524/833; 106/14.11; 427/155; 422/7

(58) Field of Search ..... 524/801, 833; 106/14.11, 14.22, 14.26; 427/155; 422/7

(56) References Cited

U.S. PATENT DOCUMENTS 5,766,817 A * 6/1998 Cheng et al.
5,952,398 A * 9/1999 Dietz et al.

FOREIGN PATENT DOCUMENTS

| | | |
|---|---|---|
| EP | 421 250 | 4/1991 |
| GB | 2 007 237 | 5/1979 |

OTHER PUBLICATIONS

Chemical Abstracts, vol. 97, No. 22, Nov. 29, 1982, Abstract No. 183791, p. 72, column 2.

* cited by examiner

*Primary Examiner*—Tae H. Yoon
(74) *Attorney, Agent, or Firm*—Sughrue Mion, PLLC

(57) ABSTRACT

The method includes the steps of: preparing an organic mixture of oil, monomers selected among acrylic acid—and methacrylic acid esters and at most 25% of an acrylic or methacrylic monomer having an acide, amide, amine or epoxy group; placing the mixture in mini-emulsion in an aqueous phase in the presence of a co-solvent, preferably of the polyalkylene glycol type; and copolymerising the monomers in emulsion. When the emulsion is applied in a thin coating on a metal surface, it provides simultaneously a dry appearance, efficient protection and a pre-lubricating effect.

28 Claims, No Drawings

METHOD FOR PREPARING AN AQUEOUS POLYACRYLATE EMULSION FOR PROTECTING METAL SURFACE AGAINST CORROSION AND PRE-LUBRICATION THEREOF AND RESULTING EMULSION

The invention relates to a process for preparing an aqueous emulsion based on polyacrylates, intended for treating metal, in particular steel, surfaces so as to form, on this surface, a prelubricating dry film for protecting against corrosion.

The protection is considered to be temporary if it is not designed to be permanent; in this case, the applied film should be easy to remove or "clean" when it is desired to make the metal surface "bare" again, for example for forming, painting or enameling.

It is desirable for the protective film to have lubricating properties, either by itself, or in synergy with oils which would be applied on the film; these oils may be whole oils or soluble oils, that is to say oil-in-water emulsions.

These lubricating properties, combined or otherwise with those of oils, are very useful for forming operations, in particular sheet metal drawing operations.

Aqueous compositions containing in suspension both oil and acrylic polymers are known.

Patent application WO 96-37SS4 by the company HENKEL describes a composition prepared from acrylic "terpolymer" latexes, which is intended to be applied on a metal, in particular steel, surface; these polymers are prepared from the following monomers, the values of the proportions of these monomers being given relative to the total mass of polymers in the composition:

A: methyl methacrylate or acrylonitrile, which provides good protection to the surface against corrosion (page 7, line 5) in particular if 30%<A<80%.

B: ethyl or butyl acrylate, which reinforces the flexibility of the film applied on the surface (page 7, line 11) if 10%<B<60%.

C: acrylic or methacrylic acid whose proportion should remain low—2%<C<10%—for preserving stable emulsions and obtaining a "suitable" deposit on the surface.

The polymerization of the monomers is carried out in aqueous emulsion; the average molecular masses obtained, M, are between $10^5$ and $10^6$.

For a purely "temporary" (and nonpermanent) protection against corrosion, it is advisable to use compositions which do not risk becoming crosslinked under the application and drying conditions, so that the deposit—or protective film—obtained can be cleanable.

To improve the drawing operation for treated surfaces, that is to say to confer prelubricating properties on these compositions, it has been proposed to incorporate lubricating materials therein, as described by the documents cited below.

Patent EP 606 257 by the company PPG describes a composition intended to treat metal surfaces so as to form, on this surface, a temporary protective film against corrosion; the film obtained can be cleaned, is lubricating and is "weldable".

The compositions described comprise:

(a) an acid functional acrylic polymer having as characteristics:

glass transition temperature: −30° C.<Tg<100° C., average molecular mass: 3 000<M<100 000.

(b) a lubricating material, in a proportion of 5 to 70%, preferably 5 to 20%, "in a quantity suitable for improving drawability" chosen from a hydrocarbon wax, carnauba wax or beeswax.

(c) an aqueous-alcoholic solvent where the alcohol does not contain more than 4 carbon atoms per molecule.

The flash point of these compositions should be greater than 37.7° C.

As an example of monomers leading to an acid functional polymer, acrylic acid, methacrylic acid and the esters of these acids are mentioned.

To incorporate the lubricating material into these compositions, it is proposed to prepare these compositions by polymerization in emulsion and in the presence of the lubricating material: "in the preferred method of preparation where the polymer is prepared with the lubricating material, it is thought that there is partial grafting of the polymer with the lubricating material." (Col. 4, line 35).

Patent EP 421 250 by the company PPG describes a composition intended to treat sheet steel surfaces so as to form, on this surface, a temporary protective film against corrosion; the film obtained is cleanable, "drawable", "weldable"; it is also "formable" in the sense that the bending of a sheet metal coated with this film does not cause cracks in the film.

The compositions described comprise:

an acid function polymer prepared in solution from:

at least one monomer comprising an acid function, in a proportion ≧5% (typically 10 to 30%), such as for example an acid chosen from acrylic, methacrylic, crotonic, itaconic or maleic acid;

at least one ethylenically unsaturated monomer such as for example a styrene, a vinyltoluene, an acrylic or methacrylic acid ester such as methyl methacrylate (MMA), butyl acrylate (BuA) or 2-ethylhexyl acrylate;

an oil, in a proportion ≧5% (typically 10 to 30%), whose melting point is close to 60° C., such as hydrocarbon wax, beeswax, carnauba wax, petroleum wax, or even a vegetable or hydrocarbon oil, or a fatty acid.

To improve the drawability of a sheet metal coated with this film and its cleanability, it is proposed to prepare these compositions by polymerization, in a solvent medium, of an organic mixture of monomers incorporating oil; the average molecular mass of the polymer obtained is between and $9\times10^4$; these compositions are then emulsified so as to be easily applied as a thin film on sheet metals.

Because of the absence of "external" surfactants, the protective film obtained is less sensitive to water, which improves the resistance to corrosion.

This document gives examples of composition (samples: A, B, C) with the proportion (%) of acrylic components (BuA: butyl acrylate—Styr. : styrene—AA: acrylic acid—MDAEMA:dimethylaminoethyl methacrylate) and of oil (wax) and with the glass transition temperature of the polymer obtained; Table I summarizes Examples A, B and C.

TABLE I

EP 421 250-Examples of treatment composition

| Sample No. | Tg | Acrylic components (%) | | | Oil |
|---|---|---|---|---|---|
| A (≡E4) | +5° C. | BuA: 47 | Styr.: 30 | AA: 20<br>MDAEMA: 3 | Wax: 15% |
| B (≡E2) | −11° C. | BuA: 60 | Styr.: 20 | AA: 20 | Wax: 15% |
| C (≡E1) | −27° C. | BuA: 73 | Styr.: 7 | AA: 20 | Wax: 15% |

To apply the acrylic emulsion on the surface to be treated and to form a protective film, it is diluted in water until a proportion of solids of between 12% and 20% is obtained and it is applied on the sheet metal to be treated so as to obtain, after drying, a deposit of between 1 and 3 g/m$^2$; the appropriate dilution of the solution and surface density depend on the roughness and the porosity of the substrate.

One disadvantage of the temporary protective compositions with improved lubricating properties described in documents EP 606 257 and 421 250 is that the protective film has a fatty character; this fatty character results from the proportion of oil in the composition and from the thickness of the deposit to be applied which are necessary in order to obtain both the desired effective protection and lubricating effect.

The object of the invention is to provide a process for preparing an emulsion of acrylic or methacrylic polymers for protecting against corrosion which, although containing little oil, preserves good lubricating properties while having a dry appearance after application in a film on sheet metal and drying.

The aim of the invention is also to improve the stability of the emulsions so as, in particular, to facilitate their application on sheet metal as a thin film having, in the dry state, a surface density of less than 6 g/m$^2$.

The document JP 82 108114 A describes a process for preparing acrylic emulsions containing a wax (example of melting point: 60° C.) intended for the hydrophobization treatment of textile fibers; according to the process described, an emulsion of acrylic monomers and an emulsion of wax are prepared separately, then the emulsions are mixed, and the mixture of emulsions is polymerized; nothing indicates that the emulsion obtained has only one homogeneous organic phase; it is even possible that the emulsion obtained is composed of two phases, one polymeric, the other oily or waxy; it therefore stems therefrom that on applying this emulsion on a sheet metal, a film would be obtained having a fatty character.

The document GB 2 007 237 relates to the use of oils grafted with a polar monomer (example: acrylic acid) as emulsifier or emulsifying agent to emulsify polymers (here: elastomers) and obtain emulsions intended to serve as adhesives for the manufacture of carpets; nothing. indicates that on using this emulsifying agent for the preparation of acrylic emulsions for protecting against corrosion, the desired prelubricating effect can be obtained on sheet metals.

The subject of the invention is a process for preparing an aqueous emulsion of polymer for the treatment of a metal surface, comprising the steps consisting in:

- preparing an organic mixture comprising monomers of said polymer and a free radical polymerization initiator,
  - said monomers comprising at least one monomer M1 chosen from the group comprising acrylic acid esters, methacrylic acid esters and at least one acrylic or methacrylic monomer M2 having an acid, amide, amine or epoxy group,
  - the monomers M1 and M2 representing at least 30% of the total weight of the organic mixture and the at least one monomer M2 representing less than 25% of the total weight of the organic mixture,
- in an aqueous phase containing a surfactant suitable for emulsification, miniemulsifying said organic mixture to form colloids of said mixture,
- copolymerizing said monomers in a miniemulsion by activation of the initiator, characterized in that:
  - said organic mixture also comprises at least 0.1% by weight of oil,
  - the miniemulsion is prepared in the presence of at least one cosolvent added in a quantity representing at least 0.7% by weight relative to the total weight of the organic mixture and the aqueous phase, under conditions suitable for the average size of said colloids to be less than 1000 nm.

Said oil is miscible in said organic mixture in the proportions added and said cosolvent is miscible in the aqueous phase in the proportions added.

According to an advantageous characteristic of the invention, this cosolvent is based on polyalkylene glycol, which improves the tribological properties of the emulsion obtained.

Other advantageous characteristics of the process according to the invention are defined in the dependent claims.

The subject of the invention is also an aqueous emulsion for treating a metal surface, which can be obtained by the process according to the invention, comprising an aqueous phase and colloids based on polymer,

- the monomeric units of said polymer comprising at least one monomer M1 chosen from the group comprising acrylic acid esters and methacrylic acid esters and at least one acrylic or methacrylic monomer M2 having an acid, amide or amine group,
- the monomers M1 and M2 representing at least 30% of the total weight of said polymer and the at least one monomer M2 representing less than 25% of the total weight of said polymer,
- characterized in that:
  - said emulsion contains at least 0.7% by weight of at least one cosolvent other than water,
  - said colloids contain at least 0.1% by weight of oil,
  - the average size of said colloids is less than 1000 nm.

Other advantageous characteristics of the treatment emulsion according to the invention are defined in the dependent claims.

The subject of the invention is also a process for protecting against corrosion of a metal surface comprising the steps consisting in:

- applying to said surface an aqueous emulsion according to the invention or an emulsion prepared by the process according to the invention,
- drying the applied emulsion so as to obtain a protective film,
- characterized in that the surface density of said dried film is between 0.5 and 6 g/m$^2$.

Very conclusive trials have been carried out with a density of between 1.5 and about 2 g/m$^2$.

The subject of the invention is also a process for drawing sheet metal comprising the steps consisting in:

- applying on said sheet metal an aqueous emulsion according to the invention or an emulsion prepared by the process according to the invention,
- drying the applied emulsion so as to obtain a lubricating film,
- actually drawing said sheet metal,
- characterized in that the surface density of said dried film is between 0.5 and 5 g/m$^2$.

Very conclusive trials have been carried out with a density of about 1 g/m$^2$.

Preferably, for this lubricating application, said cosolvent is based on polyalkylene glycol.

Conventionally, it is advantageous to adjust the surface density of the dried film to the roughness of the sheet metal, so as to obtain the optimum prelubricating effect.

Advantageously, after the drawing operation, the sheet metals obtained are protected against corrosion by the film applied on the sheet metal.

Films having a surface density of between about 1 and about 2 g/m$^2$ have made it possible to obtain both an effective protection against corrosion and an optimum pre-lubricating effect.

Advantageously, the sheet metals treated using the emulsion according to the invention, in particular for protecting against corrosion and/or for drawing, can be easily welded or cut.

The invention may also have the characteristic according to which the process comprises, before drawing, a step for oiling said sheet metal provided with said dried film, preferably produced using an aqueous emulsion of oil.

The invention will be understood more clearly on reading the description which follows, which is illustrated by trials and is given without limitation.

In the description, reference is made to the accompanying figures in which FIGS. 1 and 2 are micrographs produced at the same magnification (the white line in the top left corresponds to a length of 200 $\mu$m) of dried thin films of emulsions E2 and P1 on glass plates (FIG. 1: emulsion according to the invention—FIG. 2: emulsion according to the prior art).

PRODUCTS

To prepare the treatment emulsion for temporary protection according to the invention, the following monomers are used:

at least one monomer M1 chosen from acrylic acid esters, such as n-propyl acrylate, isobutyl acrylate, n-butyl acrylate (BuA), sec-butyl acrylate, tert-butyl acrylate, n-hexyl acrylate or lauryl acrylate (LA), and/or from methacrylic acid esters such as methyl methacrylate (MMA), ethyl methacrylate, n-butyl mezhacrylate, isobutyl methacrylate, sec-butyl methacrylate, tert-butyl methacrylate, n-hexyl methacrylate, cyclohexyl methacrylate, ethylhexyl methacrylate (EHMA), lauryl methacrylate.

These esters may comprise one or more "hydroxyl" functional groups such as hydroxyethyl methacrylate or hydroxypropyl methacrylate, or one or more "epoxy" functional groups, such as glycidyl methacrylate, or alternatively one or more "amine" functional groups, or one or more "nitrile" functional groups.

at least one monomer M2 chosen from the monomers having an acid group, such as acrylic acid (AA), methacrylic acid, itaconic acid, maleic acid or fumaric acid.

The proportion of M2 monomer should be sufficient to obtain good cleanability, while remaining sufficiently low:

for the oil used for the preparation to remain miscible in the mixture of monomers, that is to say "compatible" with this organic mixture, to preserve good tribological properties, provided in particular by the polymer M1.

Thus, in practice, the proportion of monomers M2 remains less than 25% by weight of the organic mixture to be emulsified.

Preferably, to prepare the treatment emulsion for temporary protection according to the invention, an ethylenically unsaturated, polymerizable monomer M3 other than an acrylic or methacrylic ester, preferably chosen from a vinyl monomer, such as styrene, methylstyrene or vinyltoluene, is also used.

Table II-1 below presents the monomers used for the trials, as well as the glass transition temperature $T_{gM}$ value of the corresponding homopolymers which is used to calculate the glass transition temperature $T_g$ of the polymer obtained in the emulsion according to the invention.

The proportions of the various monomers M1, M2, and optionally M3 in the composition are adjusted in a manner known per se so as to obtain both good film-forming properties for the emulsion and a glass transition temperature ($T_g$) of the polymer of between −40° C. and +20° C.

TABLE II-1

Abbreviation of the monomers

| Abbreviation | Name of the monomer | $T_{gM}$ | Monomer family |
|---|---|---|---|
| BuA | Butyl acrylate | −54° C. | Acrylic ester (M1) |
| LA | Lauryl acrylate | −3° C. | Acrylic ester (M1) |
| MMA | Methyl methacrylate | +105° C. | Methacrylic ester (M1) |
| EHMA | 2-Ethylhexyl methacrylate | −10° C. | Methacrylic ester (M1) |
| AA | Acrylic acid | +109° C. | "with acid group" (M2) |
| NMA | Hydroxymethylacrylamide | +166° C. | . . . "with amide functional group" |
| MDAEMA | Dimethylaminoethyl methacrylate | +19° C. | . . . "with amine functional group" |

The good film-forming properties of the emulsion are those which make it possible to apply, on a substrate, a thin film of homogeneous thickness; the film should be thin so as to be able to have a dry appearance and should be homogeneous so as to be effective against corrosion.

If the glass transition temperature of the film is less than 0° C. approximately, the thin film is generally sufficiently flexible and resistant to effectively protect against corrosion above 0° C. approximately; in particular when polyalkylene glycol is incorporated into the film as described below, it is observed that these properties of the film are preserved even when $T_g$ is greater than 0° C., as long as $T_g$ remains less than 20° C. approximately.

If $T_g$ was greater than 20° C., there would be a risk of deterioration of the film-forming character as well as the tribological performance features.

The so-called FOX-FLORY equation makes it possible to link the glass transition temperature $T_g$ of a heteropolymer to the proportions of monomers in this polymer:

$$1/T_g=\Sigma(W_m/T_{gM})$$

where $W_M$ is the fraction by mass of the monomer M in the polymer, and $T_{gM}$ is the glass transition temperature of the homopolymer corresponding to the monomer M.

To prepare the emulsion for temporary protective treatment according to the invention, oil is also used; as indicated below, the oil has an intrinsic "cosurfactant" effect of improving the stability of the emulsion and an extrinsic effect on the performance features of the emulsion.

To obtain a sufficiently stable treatment emulsion, having colloids whose average diameter is less than 1000 nm, which is efficient in relation to corrosion resistance and in relation to lubrication, it is advisable, according to the invention, to add at least 0.1% oil, preferably at least 1% oil, expressed relative to the mass of the starting organic phase.

To obtain a treatment film with a dry appearance, it is necessary for practically all the oil added to the starting organic mixture to be able to be integrated into the colloids of the emulsion under the physical and chemical conditions for emulsifying this mixture, in particular so that the colloids of acrylic polymer of the emulsion obtained contain this oil; in this way, the emulsion obtained does not have a fatty appearance when it is applied as a thin film; in practice, the Quantity of oil, expressed relative to the mass of monomers of the starting organic mixture or to the organic phase of the emulsion obtained thus remains less than 5%.

As oil, there may be used natural oils of the animal, vegetable or mineral (petroleum) type or synthetic oils; for the trials below, paraffin oil (abbreviation: "paraf."), or an oil QUACLAD® with the reference N8021 from the company QUAKER (abbreviation: "Q.N8021"), or castor oil (abbreviation: "castor") which is essentially composed of ricinoleic acid triglyceride, is used.

The acrylic polymer of the emulsion according to the invention is polymerized in emulsion; thus, to prepare this emulsion and then polymerize, the following are also used:

an organosoluble, generally heat-activable, free radical polymerization initiator; an initiator is for example chosen which belongs to the peroxide family and to the family of azo compounds; the initiator used in the trials is 2,2'-azobisisobutyronitrile (AIBN), which is active from about 60° C.

at least one surfactant for emulsifying the organic phase in the aqueous phase: in the trials, a mixture of nonionic surfactant, such as polymethyl methacrylate-poly (ethylene oxide) (PMMA-PEO), and an ionic surfactant, such as sodium dodecyl sulfate (SDS) is used; this mixture of emulsifying agents makes it possible to obtain particularly stable treatment emulsions even at high shear rates as are caused when the treatment emulsion is applied by spraying; the use of emulsifying agent prepared by grafting acrylic acid on oils as described in the document GB 2 007 237 would not make it possible to obtain the required stability.

For the polymer emulsion obtained to be sufficiently stable during storage (zero shear rate) and under application conditions (high shear rate), and for it to be capable of being applied homogeneously as a thin film, in particular at a surface density as low as 0.5 g/m$^2$, it is advisable for the average size of the colloids to remain less than 1000 nm, preferably less than or equal to 500 nm; thus, the emulsions according to the invention belong to the category of "miniemulsions", as defined below.

In general, emulsions are classified into three main categories according to the size of their colloids:

conventional emulsions, also called "macroemulsions"; they are generally prepared by mixing two immiscible liquids with one or more ionic or nonionic surfactant(s) or a mixture of these two types; the emulsion obtained exists in the form of droplets whose size is close to a micrometer; macroemulsions are opaque, milky in appearance and tend to settle out during storage.

"microemulsions"; they are prepared using a mixture of surfactants with a cosurfactant, generally a mixture of ionic surfactants with an alcohol having a short carbon chain (of the pentanol or hexanol type); microemulsions are thermodynamically stable dispersions of oil in water or conversely of water in oil, which have spherical droplets or colloids, whose diameter is less than one quarter of the wavelength of visible light, that is of the order of 10 to 100 nm; because of this small size, microemulsions are translucent or even transparent.

"miniemulsions"; they are prepared using a mixture of ionic and/or nonionic surfactant(s) with a cosurfactant such as a fatty alcohol or alternatively an alkane having a long carbon chain; it is also accepted that miniemulsions have two main characteristics: high stability and size of the particles or colloids generally of between 50 and 1000 nm, preferably between 50 and 500 nm; miniemulsions are fluid, opaque and milky in appearance.

The acrylic polymer of the emulsion according to the invention is therefore polymerized in miniemulsion, so as to obtain an emulsion which is more stable and easier to apply than when the polymerization is carried out in a conventional emulsion of the macroemulsion type; thus, to prepare this miniemulsion, a cosurfactant and a cosolvent are additionally used:

as cosurfactant there is used, according to the invention, the oil already described as component of the starting organic mixture or as component integrated into the colloids of acrylic polymers of the emulsion obtained; other conventional cosurfactants may be added;

the expression cosolvent is understood to mean a non-aqueous solvent which is miscible in water; as cosolvent, ethanol or hexadecane may be used; preferably, to improve the performance features of the lubrication of the emulsion according to the invention, a polyalkylene glycol is used as cosolvent; it is preferable to use a polyalkylene glycol which is in the liquid state at the temperature for preparing the miniemulsion.

The emulsion according to the invention may also contain other additives: for example, other surfactants for promoting the wetting of the surface to be treated, antifoaming agents, corrosion inhibitors, bactericidal agents, fragrances, colorants or pigments.

The corrosion inhibitors may be for example chosen from:

(1)—salts of acids and salts of amines, (2)—salts of fatty alcohols, optionally ethoxylated and/or phosphated, (3)—salts of zinc, of carboxylic, optionally fatty, acids, (4)—borates and/or phosphates of alkanol-amine, (5)—phosphates of aluminum or zinc.

The inhibitors used for the trials are presented in Table II-2 below, designated by their commercial reference, with the name of the company marketing them, the abbreviation used later to designate them, their essential components designated by a number (1) to (5) with reference to the list above, and their principal characteristics.

TABLE II-2

Corrosion inhibitors

| Abbreviation | Commercial reference | Company | Composition/ characteristics |
|---|---|---|---|
| BBA | Emadox BBA | LABEMA | (4) borate – lubricant |
| NB | Emadox NB | | (4) borate + phosphate – adherent |
| 3059E | 3059E | SIDOBRE SINNOVA | Emulsifiable polyamine |
| RC305 | Ibda RC305 | CRODA | (4) borate |
| I 252 | Irgacor 252 FC | CIBA | (3) |
| I 1405 | Irgacor 1405 | | hydrophobic |
| I 1930 | Irgacor 1930 | | |
| S379 | Set Ad Fa 379 | CONDEA-SERVO | (1) – adherent effect |

METHODS

The polymers of the compositions according to the invention are prepared, in a manner known per se, by free radical polymerization in emulsion in the presence of a free radical initiator; according to the invention, the oil is added to the starting organic mixture before emulsifying, in contrast to the process described in JP 82 108114 A already cited.

To prepare an aqueous emulsion according to the invention, the procedure is carried out as follows:

1/ Preparation of the starting organic phase: there is prepared, in the proportions envisaged, an organic mixture of monomers comprising M1, M2 and optionally M3, oil in predetermined proportions, finally the organosoluble initiator; the mixture is prepared, with stirring, so as to obtain a homogeneous organic phase; as stirring means, mechanical means or ultrasound may for example be used.

It is advisable that the conditions for preparing the mixture, such as the temperature and the method of stirring, are suitable in order to avoid, or at the very least to limit, initiation of polymerization at this stage; thus, if the initiator is AIBN, which is active as soon as the temperature exceeds 60° C., it is advisable:

- to maintain the mixture at a temperature clearly less than 60° C.,
- to adapt the stirring means so as to limit heating of the mixture clearly below 60° C.; thus, it is preferable to stir using mechanical means rather than using ultrasound.

2/ Preparation of the aqueous phase: the surfactant(s) is (are) dissolved in demineralized water; in this embodiment, no cosolvent or cosurfactant is introduced at this stage.

3/ The preparation of the miniemulsion of the organic phase in an aqueous phase is then carried out in a conventional manner, for example in the following manner: the organic phase is added dropwise, with stirring, to the aqueous phase, and then, still with stirring for homogenization, one or more cosolvents and, optionally, one or more cosurfactants are added, optionally under conditions suitable for forming a miniemulsion whose organic droplets or colloids have a diameter of less than 1000 nm, preferably of less than or equal to 500 nm, and therefore less than the thickness of the dry protective film to be produced.

The addition of a cosurfactant is optional because, according to the invention, the oil constituting the starting organic phase already plays the role of cosurfactant; other conventional cosurfactants may be added at this stage, such as a fatty alcohol, an alkane having a long carbon chain comprising a number of carbon atoms greater than or equal to 10.

According to one variant of the invention, the cosolvent is added to the aqueous phase before the step for preparing the miniemulsion; a cosolvent which is miscible in water in the required proportions is chosen.

The stirring and homogenization conditions for forming the emulsion are subject to the "physical" preparation conditions, while the nature and the proportions of surfactants and cosurfactants such as the oil in the starting organic phase, and of cosolvents are subject to the "chemical" preparation conditions; these physical and chemical conditions are adjusted in a manner known per se so as to succeed in preparing the miniemulsion, based on the criteria of size of the colloids and of stability of the emulsion required.

Thus, for stirring and/or homogenizing, a turbine of the ULTRATURAX® type may be used so as to shear the mixture at high speeds.

The size of the colloids obtained may be monitored by conventional measurements based on the virtually elastic scattering of light.

It is very important, at this stage of the preparation, that the oil of the starting organic phase i s integrated into the colloids and is suitably distributed therein; if the proportion of oil exceeds a so-called compatibility limit, for a given starting organic mixture and given emulsifying conditions, two different populations of colloids will appear after emulsifying and the treatment composition resulting from this emulsion does not make it possible to obtain a "dry", that is to say nonfatty, protective film.

The distribution of the colloids of the emulsion according to their size may be established by conventional measurements, such as measurements based on the virtually elastic scattering of light; this distribution curve makes it possible to determine if the emulsion has:

- a single homogeneous population: the distribution curve has only one maximum,
- several populations: the distribution curve has several maxima.

The presence of a single population in the emulsion indicates that the oil is integrated into the colloids in accordance with the invention; on the contrary, the presence of two distinct populations in the emulsion indicates that the oil is not integrated into the colloids and that the emulsion does not conform to the invention.

4/ The polymerization in emulsion is then carried out in a conventional manner, for example in the following manner: conditions for activating the initiator are applied to the miniemulsion obtained; if the initiator is heat-activable, the miniemulsion is heated above the temperature for activating the initiator, in this case for AIBN between 60° C. and 100° C.; the emulsion is maintained under these conditions for the period necessary to obtain polymerization, in this case of the order of 24 hours; during this time, the emulsion is deoxygenated under a nitrogen stream.

A miniemulsion of acrylic or methacrylic polymers is then obtained which is ready for use, after a possible dilution with water, so as to treat a surface, and capable of forming, on this surface, a thin and dry film which is both protective and lubricating.

The treatment emulsion according to the invention is therefore polymerized in emulsion unlike those described in EP 421 250 already cited, where the polymerization is carried out in a solvent medium.

The basic components of the emulsion according to the invention are emulsified together starting with a single organic phase containing the monomers and the oil, and not separately as described in JP 82 108 114 A already cited.

From these differences in relation to EP 421 250 and to JP 82 108 114 A, it is observed that the result is that the emulsion according to the invention is more stable, easier to apply and that it is easier to obtain dry films because the oil has a cosurfactant effect and is integrated into the polymer colloids.

As indicated above, other additives may be integrated into the mixture intended to form the miniemulsion or at a subsequent stage of the preparation, or even into the ready-to-use emulsion; corrosion inhibitors in particular are used.

In the trials below, the optional addition of inhibitor is explicitly indicated and then corresponds to an addition of at least one of the inhibitors cited in Table II-2, each at a concentration of 10 g/l in the ready-to-use emulsion.

For solely "temporary" protection against corrosion, when it is desired for the film resulting from the treatment to be easily cleanable, the emulsion according to the invention should not contain any crosslinking agent, in order to avoid any crosslinking of the deposit after application, which would be damaging to the desired cleanability.

The aqueous dispersions obtained are therefore stable, fluid and uniform; the particles of polymers in dispersion generally have a mean diameter of between 50 and 1000 nm;

the proportion of solid matter in dispersion is generally between 10 and 50% relative to the total weight of the emulsion; in the examples below, this proportion is generally 18%.

It is possible to determine, for example by differential scanning calorimetry, the glass transition temperature (Tg) of the polymeric solid phase of the emulsion; this temperature essentially depends on the nature and the proportions of the monomers, as indicated above; the addition of oil generally has the effect of reducing this glass transition temperature; generally: $-55° C. \leqq Tg \leqq +40° C.$ The influence of the presence of oil on the glass transition temperature is also a means of verifying the integration of the oil into the colloids; the absence of influence may be an indication of absence of integration of the oil into the colloids.

In the trials below, the following values of Tg were generally aimed for: −40° C., −20° C., 0° C. and 20° C.

TESTS of the Emulsions Obtained:

For the friction tests, test pieces made of steel of the BS2 variety are used, which have a roughness $1\ \mu m < R_a < 1.2\ \mu m$ and dimensions 2×40×500 mm.

For the corrosion tests, test pieces made of steel of the S235 variety are used, which have the dimensions 2×100×100 mm.

1—Friction and lubrication test:

For the tribology tests, a plane-plane tribometer of a type known per se is used.

The test pieces are clamped with a clamping force $F_s$ between two small high-speed steel plates having a surface area of 1 $cm^2$.

The friction coefficient k is measured while moving the test piece at a constant speed V with respect to the small plates over a total distance D of 180 mm, while progressively increasing the clamping force $F_s$ from 200 daN at the start of the test to 2000 daN at the end of the test.

The pull speed V is 10 mm/s, unless otherwise specified.

The curve showing the variation in friction coefficient k as a function of time or of the clamping force $F_s$ is generally a decreasing curve, but more rarely a constant curve; in order to evaluate the tribological performance, the friction coefficient is generally measured at the end of the curve, for $F_s \approx 1800$ daN.

For some trials, the test pieces are oiled after possible surface treatment using a protective emulsion; in this case, the oil load applied is of the order of 2 $g/m^2$; the nature of the oil is variable.

2—"Hot wet" corrosion test (or "humido" or "FKW"):

The test pieces are placed as they are in a controlled environment chamber, corresponding to the DIN 50017 standard published in October 1982, and simulating the corrosion conditions for an outer turn of a coil of sheet metal or of sheet metal cut into sheets during storage.

The controlled environment cycle to which the test piece is subjected is the following: 8 h at 40° C. and 95% to 100% humidity—16 h at 20° C. and 75% relative humidity.

The result of the test is obtained by noting the number of successive cycles (abbreviated No. cyc.) before traces of corrosion appear on the test piece.

3—"Transport" corrosion test:

The test pieces are placed in a controlled environment chamber in clamped packets of 4 test pieces, simulating the corrosion conditions at the center of a coil of sheet metal during a transport stage.

The controlled environment cycle to which the packet of test pieces is subjected is the following: 10 h at 40° C. and 95% humidity—4 h at 20° C. and 85% humidity—10 h at −5° C. and 0% humidity—8 h at 30° C. and 85% relative humidity.

The result of the test is obtained by carrying out six cycles and then observing the possible traces of corrosion of the test pieces—corrosion pits and/or stains—and classifying the observations on a scale of 5 scores (abbreviated "sco"): 0 for absence of corrosion pit, 5 for generalized staining.

More precisely, 0=no corrosion pits—0.25=1 corrosion pit—0.5=2 corrosion pits—0.75=3 corrosion pits—1 means>3 corrosion pits—2 means one weak pitting, 3 average, 4 intense and 5 generalized.

4—Cleanability test:

To evaluate cleanability (in %), a procedure in accordance with the Renault D691713/.C method is used.

A coated test piece is subjected to the action of an alkaline cleaning bath, under defined conditions.

The ability of the product to be cleaned is evaluated by the degree of wetting of the test piece after cleaning.

The cleaning bath has the following composition:

demineralized water sodium metasilicate (35 g/l)

trisodium phosphate (16 g/l)

ethoxylated nonylphenol at 10 mol (4 g/l)

nitriloacetic acid (2 g/l).

The test piece is completely immersed in this bath at 60° C. for 3 minutes.

The sample is then cleaned in a crude water bath for one minute and then under a water jet for 30 seconds.

After rinsing, holding the test piece inclined at 45°, the percentage of wet area after draining for 30 seconds should be estimated.

The surface areas on which there is no rupture of the water film are considered to be 100% cleaned; otherwise, the percentage of nonwetting is noted by subtracting it from 100%.

TRIALS

Using the PRODUCTS and using the METHODS which have just been described, emulsions of polymers are prepared from:

an organic phase: 110 g approximately of a mixture of monomers with 2.2 g AIBN as initiator, and oil of variable nature and proportion.

an aqueous phase: 500 g of demineralized water with 8.25 g of PMMA/PEO and 0.5 g of SDS as surfactants, and 75 ml of ethanol as cosolvent.

For the preparation of the organic phase, unless otherwise specified, the stirring is carried out using ultrasound; the composition of the starting organic phases used for the trials is indicated in Table III: reference number for the emulsion (No.), components—monomer or oil—as an abbreviation (see Table II-1) followed by a figure indicating the weight involved in grams.

The level of solid matter in the emulsions obtained is 18%, except for sample H2 which has a solid matter level of 30%.

TABLE III

List of the emulsions tested

| | Monomers | | | | |
|---|---|---|---|---|---|
| No. | M1 | | M2 | M3 | Oil |
| A2 | BuA: 100 | | AA: 9 | | paraf.: 2.75 |
| B1 | BuA: 90 | MMA: 9 | MDAEMA: 11 | | paraf.: 2.75 |

TABLE III-continued

List of the emulsions tested

| No. | Monomers M1 | | M2 | M3 | Oil |
|---|---|---|---|---|---|
| C1 | BuA: 94.6 | MMA: 4.4 | NMA: 11 | | paraf.: 2.75 |
| C2 | BuA: 84.7 | MMA: 14.3 | NMA: 11 | | paraf.: 2.75 |
| C3 | BuA: 59.4 | MMA: 39.6 | NMA: 11 | | paraf.: 2.75 |
| D1 | BuA: 94.6 | NMA: 11 | AA: 4.4 | | paraf.: 2.75 |
| D2 | BuA: 59.4 | NMA: 11 | AA: 39.6 | | paraf.: 2.75 |
| E1 | BuA: 94.6 | MMA: 4.4 | AA: 11 | | paraf.: 2.75 |
| E2 | BuA: 74.8 | MMA: 24.2 | AA: 11 | | paraf.: 2.75 |
| E4 | BuA: 59.4 | MMA: 39.6 | AA: 11 | | paraf.: 2.75 |
| E3 | BuA: 74.8 | MMA: 11 | AA: 24.2 | | paraf.: 2.75 |
| E5 | BuA: 59.4 | MMA: 11 | AA: 39.6 | | paraf.: 2.75 |
| E2 | BuA: 74.8 | MMA: 24.2 | AA: 11 | | paraf.: 2.75 |
| F1 | BuA: 74.8 | MMA: 24.2 | AA: 11 | | castor: 2.75 |
| G1 | BuA: 74.8 | MMA: 24.2 | AA: 11 | | Q.N8021: 2.75 |
| E9 | BuA: 74.8 | MMA: 24.2 | AA: 11 | | paraf.: 11 |
| H1 | BuA: 74.8 | | AA: 11 | styrene 24.2 | paraf.: 11 |
| H2 | BuA: 150 | | AA: 22 | styrene 44 | paraf.: 5.5 |
| J1 | EHMA: 74.8 | LA: 24.2 | AA: 11 | | paraf.: 2.75 |

Application of the Emulsions on a Substrate:

To test the emulsions, hot-rolled or cold-rolled steel, uncoated or coated with a metal layer, for example zinc, may be used.

The metal surface to be treated should be clean, free of dirt and of traces of oil; the emulsion may be applied on leaving the pickling line.

If the pH of the emulsions obtained is not between 7 and 11, it is preferable to adjust it so as to obtain a pH of between 7 and 11, so as to avoid any risk of corrosion of the substrate by the emulsion.

To apply the emulsion on the sheet metal to be treated, the procedure may be carried out by spraying, immersion, coating or even centrifugation; after application, the deposit obtained is dried at a temperature generally of between 40° C. and 150° C., for example by blowing hot air.

The application and drying conditions are adjusted so as to obtain a film which, after drying, has a surface density of between 0.5 and 6 9/m$^2$; the protective film obtained is not crosslinked, so as to be, if possible, easy to remove (cleaning) for the protection provided to indeed have a "temporary" character.

Results of the Tests (procedures: see § TESTS)

The emulsions described in Table III were applied by immersion or sprayed on samples of hot-rolled and pickled bare steel of BS2 or S235 grade, dried at about 40° C. for about 15 minutes.

The application conditions are adjusted so as to obtain a dry film of about 2 g/m$^2$.

All the films obtained from emulsions in which the quantity of incorporated oil, expressed relative to the mass of monomers, is less than 5% have a dry appearance; for higher proportions of oil, the films obtained have a more or less pronounced fatty appearance: the appearance considered is visual and tactile.

The treated samples, referenced by the treatment emulsion number, are then tested according to the procedures described above (§ TESTS); the results obtained are reported in Tables IV to IX.

TABLE IV

Tests: influence of NMA

| BuA/NMA/MMA | Samples: | C1 | C2 | C3 |
|---|---|---|---|---|
| | Tg | −40° C. | −20° C. | 0° C. |
| | Friction (coef.) | 0.09 | 0.1 | 0.12 |
| | Humido. (no. cyc.) | 5 | 5 | 5 |
| | Transport (sco.) | 2 | 3 | 1.5 |
| | Cleanability | no | no | no |
| BuA/NMA/AA | Samples: | D1 | | D2 |
| | Friction (coef.) | 0.08 | | — |
| | Humido. (no. cyc.) | 6 | | — |
| | Transport (sco.) | 1 | | 1 |
| | Cleanability | no | | no |

TABLE V

Tests: influence of BuA/MMA and BuA/AA

| BuA/AA/MMA | Samples: | E1 | E2 | E3 |
|---|---|---|---|---|
| | Tg | −40° C. | −20° C. | 0° C. |
| | Friction (coef.) | 0.08 | 0.10 | 0.15 |
| | Humido. (no. cyc.) | 3 | 10 | 5 |
| | Transport (sco.) | — | 1 | — |
| | Cleanability | yes | yes | yes |
| BuA/AA/MMA | Samples: | E1 | E3 | E5 |
| | Tg | −40° C. | −20° C. | 0° C. |
| | Friction (coef.) | 0.08 | 0.08 | 0.15 |
| | Humido. (no. cyc.) | 3 | 1 | 1 |
| | Transport (sco.) | — | — | — |
| | Cleanability | yes | yes | yes |

TABLE VI

Influence of the nature of the ethylenically unsaturated monomer

| BuA/AA/ . . . → | Samples: 3rd component: | E9 MMA | H1 styrene | E2 MMA | H2 styrene |
|---|---|---|---|---|---|
| | Level of solid matter | 18% | 18% | 18% | 30% |
| | Level of oil | 10% | 10% | 2.5% | 2.5% |
| | Tg | −20° C. | −20° C. | −20° C. | −20° C. |
| | Friction (coef.) | 0.08 | 0.12 | 0.10 | 0.08 |
| | Humido. (no. cyc.) | 9 | 7 | 10 | 8 |
| | Transport (sco.) | 0.5 | 1 | 1 | 0 |
| | Cleanability | yes | yes | yes | yes |

TABLE VII

Tests: influence of the nature and of the quantity of the oil

| Nature Oil | Quantity (%): | 0 | 1 | 2.5 | 5 | 10 | 20 |
|---|---|---|---|---|---|---|---|
| Paraffin ("paraf.") | Sample: | | | E2 | | E9 | E11 |
| | Friction (coef.) | 0.12 | 0.10 | 0.10 | 0.10 | 0.08 | 0.10 |
| | Humido. (no. cyc.) | 1 | 5 | 10 | 5 | 9 | — |
| | Appearance | dry | dry | dry | dry | fatty | fatty |
| Castor | Sample: | | | F1 | | F2 | F3 |
| | Friction (coef.) | 0.12 | | 0.10 | | 0.08 | |
| | Humido. (no. cyc.) | 1 | | 2 | | — | — |
| | Appearance | dry | | dry | | fatty | fatty |

TABLE VII-continued

| Nature Oil | Quantity (%): | 0 | 1 | 2.5 | 5 | 10 | 20 |
|---|---|---|---|---|---|---|---|
| | | Tests: influence of the nature and of the quantity of the oil | | | | | |
| Q.N8021 | Sample: | | | G1 | | G2 | |
| | Friction (coef.) | 0.12 | | 0.06 | | 0.10 | |
| | Humido. (no. cyc.) | 1 | | 10 | | — | |
| | Appearance | dry | | dry | | fatty | |

TABLE VIII

Tests: influence of the mode of preparation of the polymer

| Samples: Polymerization in . . . | | E2 emulsion | P1 solution |
|---|---|---|---|
| Nature Oil Paraffin | Quantity: . . . incorporated . . . | 2.75 before polymerization | 2.75 before polymerization |
| | Friction (coef.) | 0.10 | 0.10 |
| | Humido. (no. cyc.) | 10 | 3 |
| | Transport (sco.) | 1 | — |
| | Microscope observation of the film: | FIG. 1 dry appearance homogeneous | FIG. 2 fatty appearance oil droplets |

TABLE IX

Influence of: mode of mixing of organic phase-cosolvent

| Samples: | | E2 | E2" | E2"' | $E2^{IV}$ |
|---|---|---|---|---|---|
| Mixing organic phase by . . . (with paraffin oil: 2.5%) | | . . . ultra-sound | mechanical stirring | me-chanical stirring | me-chanical stirring |
| cosolvent: | | ethanol | ethanol | PEG 200 | PEG 200 |
| quantity: | | 75 ml | 75 ml | 75 ml | 75 ml |
| Perform-ance of emulsion | Friction (coef.) | 0.10 | 0.07 | 0.03 | 0.05 |
| | Humido. (no. cyc.) | 10 | 10 | 7 | 8 |
| | Transport (sco.) | 1 | 1 | 1 | 0 |
| | Microscope observation of the film | FIG. 1 dry appearance homo-geneous | Dry appearance | Dry appear-ance | Dry appear-ance |

To prepare these emulsions, the mixing of the constituents of the starting organic phase is carried out with stirring by ultrasound, except for trial E"2 and E'"2 where the stirring is carried out with a mechanical stirrer rotating in the mixture.

For the preparation of these emulsions, ethanol was used as cosolvent, except for trial E'"2 where polyethylene glycol with an average molecular mass of 200 g/mol (abbreviation: "PEG 200") was used in an identical quantity as a replacement for ethanol.

CONCLUSIONS ON THE RESULTS OF THE TESTS

Influence of the Quantity of Oil Incorporated

Table VII shows that a small proportion of oil (≈2.5% in the case of paraffin oil) introduced according to the invention makes it possible to obtain a treatment emulsion giving good tribological performances (low coefficient of friction) and a very good corrosion resistance, by applying the emulsion in a fairly low quantity (2 g/m$^2$) while preserving a dry, that is to say nonfatty, appearance.

For all the oils tested, the optimum performances of the emulsion is less than 5% by weight in the organic phase and greater than or equal to 1%: the modality corresponding to 2.5% appears to give satisfactory results for all these oils; the "1%" modality, which was tested only for paraffin oil, also gives good results.

Thus, preferably, the concentration of oil in the starting organic mixture is greater than or equal to 1% and less than 5%.

In particular in the case of paraffin oil, the variation in hot-wet corrosion resistance passes through a maximum corresponding to only 2.5% of oil (relative to the weight of polymer) in the emulsion; a very high corrosion resistance value is also observed in the case of Q.N8021 oil for the same proportion of 2.5%.

Thus, by virtue of the presence of oil in the starting organic phase, emulsions are obtained which are more stable (cosurfactant effect) and exhibit greater performance features (corrosion resistance—lubrication—dry film), where the oil is incorporated into the polymer colloids.

Influence of the Nature of the Oil

Table VII therefore presents the results obtained with three different oils: paraffin oil ("paraf."), castor oil and oil designated by the reference "Quaclad 8021" from the company QUAKER ("Q.N8021").

It is observed that the results are substantially better for paraffin oils and for QUAKER N8021 oil than for castor oil; it is observed that paraffin oil and the Q.N8021 oil were perfectly miscible with the M1 monomers used (BuA and MMA) whereas the constituents of the mixture of castor oil and either of BuA or of MMA had a tendency to separate; the poor compatibility between castor oil and these M1 monomers is attributed to the polar character of the castor oil which is a hydroxylated oil; to carry out the invention under the best conditions, it is therefore preferable that the oil used is miscible in the mixture of monomers, in particular in the M1 and, where appropriate M3, monomers.

The nature of the vegetable, mineral or synthetic oil is thought to have no influence on the stability of the emulsions obtained.

Influence of the Mode of Incorporation of the Oil

To illustrate the effect resulting from the incorporation of oil into the organic mixture before polymerization in emulsion, a treatment emulsion E'2 was prepared in the same manner as the emulsion E2, the only difference being that the oil was added after polymerization in emulsion.

On applying emulsions E2 and E'2 on a metal surface to be treated so as to obtain thin films of the same thickness, it is observed that, in the case of the emulsion E'2, a film with a fatty, non-dry appearance is obtained whereas, in the case of the emulsion E2, the film obtained has a dry appearance; the tribological properties of the two films are practically identical.

Influence of the Mode of Polymerization on the Incorporation of Oil

Table VIII shows the extent to which the mode of incorporation of the oil and the mode of polymerization according to the invention are important for obtaining a very substantial improvement in corrosion resistance with only a small quantity of oil and for obtaining a dry appearance.

For the sample P1 (cf. Table VIII), the polymerization is carried out in solution in the presence of oil, in the description given in the documents EP 421 250 and EP 606 257 already cited; the polymer obtained incorporating the (oil is then redispersed to form an emulsion ready to be applied on a sample of sheet steel; on the emulsion obtained, it is observed that the oil floats on the surface of the emulsion, which shows that the oil, even in a small quantity, is not completely incorporated into the colloids of the emulsion.

Emulsions E2 and P1 have exactly the same composition.

A dried thin film of emulsion E2 and P1 is applied on glass plates, for observation under a microscope (FIG. 1 and FIG. 2 respectively); it is observed:

that the film derived from the emulsion E2 according to the invention has a dry appearance, has a homogeneous facies which does not reveal visible droplets of oil;

that the film derived from the emulsion P1 has on the contrary a fatty appearance, has a heterogeneous facies which reveals multiple and sometimes large, very visible droplets of oil.

It is finally observed that the corrosion resistance of the film derived from the emulsion E2 is at least three times higher than that of the film derived from the emulsion P1, whereas the compositions are identical.

Influence of the Mode of Mixing of the Starting Organic Phase

Table IX shows that the mode of mixing of the constituents of the organic phase at the beginning of the preparation has a considerable influence on the tribological properties: a mechanical stirrer moving in the bath (case E2") gives an emulsion of polymers which is more lubricating than that which is obtained from the same mixture stirred by ultrasound (case E2).

Influence of the Nature of the Cosolvent

Comparison of the performances of the emulsions E"2 and E'"2 (able IX) illustrates a preferred variant of the invention according to which polyalkylene glycol is used as cosolvent so as to substantially improve the lubricating properties of the emulsion: the use of PEG 200 in place of ethanol makes it possible to divide the coefficient of friction by about 2.

PEG 200 is also advantageous to use as a replacement for ethanol because its flash point is higher: >180° C. against about 16° C. for ethanol.

Still on the basis of the organic phase corresponding to E2 (Table III) mixed with mechanical stirring, emulsions according to the invention were prepared by varying the quantity of cosolvent P-G 200, in the range 0.7 to 9% by weight relative to the total weight of the emulsion ready for application.

9% corresponds to the emulsion E'"2 of Table IX, that is to say to 75 ml of PEG 200 added at the miniemulsion preparing stage; 4% corresponds to the emulsion E2,v with 30 ml added.

The performances of the emulsions obtained justify the following observations:

below 4% PEG, it is observed that a surface treated with the emulsion gives rise to friction chattering; the corrosion resistance varies from 4 to 9 cycles according to the wet-hot test;

above 4% PEG, the friction behavior improves: absence of chattering, reduction in the coefficient of friction; but the corrosion resistance deteriorates.

The best compromise at the level of the performances is therefore obtained with a concentration of 4% by weight of PEG 200 relative to the total weight of the ready-to-use emulsion which itself contains 18% by weight of dispersed polymer.

Thus, according to this variant of the invention, not only the oil but also the polyalkylene glycol have:

an intrinsic cosurfactant or cosolvent effect having a favorable influence on the stability of the emulsion, an extrinsic effect on the performances of the emulsion.

Influence of Hydroxymethylacrylamide (NMA) on Cleanability

Tables IV and V show that the presence of hydroxymethylacrylamide (NMA) in the polymer formulation does not make it possible to obtain films which are easy to clean, even in the presence of acrylic acid (AA); to obtain a protection with a "temporary" character, it is therefore important to use a sufficient quantity of acrylic acid (here, 10% -component "M2") and to avoid introducing monomers with an amide functional group into the formulation.

Influence of the Component "M1" of acrylic or methacrylic esters

Tables IV and V show that, in the polymer composition, the reduction in the proportion of acrylic ester (BuA) in favor of that of methacrylic ester (MMA) causes a slight deterioration in the tribological properties (compare on the one hand E1, E2, E4 and on the other hand C1, C2, C3).

From the point of view of the resistance to corrosion and with reference to the emulsions E1, E2 and E4 (Table V), it is considered that:

in the sample E1, there is not enough methacrylic ester (MMA) to confer a sufficiently film-forming character on the emulsion; the thin protective film cannot therefore be sufficiently homogeneous and the protection which it provides is not uniform;

in the sample E4, there is not too much methacrylic ester (MMA) and the glass transition temperature is too high for this composition, which does not allow high mobility of the coating after film formation; the thin protective film is quite fragile, may therefore be porous and therefore permeable and the protection which it provides 1s not uniform.

The respective proportions of acrylic ester (BuA) and of methacrylic ester (MMA) should therefore be adjusted to obtain both a highly film-forming emulsion and a very flexible dry protective film; a good compromise between these two constraints consists in formulating the emulsion (see the abovementioned FOX-GLORY equation) so as to obtain a polymer whose glass transition temperature is less than or equal to 20° C., greater than −400° C.

Influence of the Acid Functionalized Monomer "M2" component:

When only "temporary" protection against corrosion is sought, the proportion of acid functionalized monomer "M2" relative to the weight of the monomers in the organic mixture should be sufficiently high to allow removal by cleaning of a protective film resulting from the application of the emulsion.

From the point of view of the corrosion resistance and with reference to the emulsions E2, E3 and E5 (Table V), it is considered that the introduction of an excessively large quantity of monomer M2 (AA), greater than 10%, poses problems of compatibility of the starting organic mixture with the oil, in particular when this oil is apolar (case of paraffin oil); because of this, for the emulsions E3 (about 25% of monomer M2) and E5 (about 40% of monomer M2), it would appear that the oil is not effectively incorporated into the colloids of polymers, which does not allow effective protection against corrosion; in parallel, in the case wherein M2 is an acid functionalized monomer, an excessively high proportion generates a protective film which is too hydrophilic to effectively protect against corrosion; it can be deduced therefrom that, in practice, to obtain effective protection against corrosion, the proportion of monomers M2 should be less than 25% of the total weight of the monomers used in the preparation of the emulsion.

From the point of view of the tribological properties, it is observed, moreover, that the coefficient of friction increases considerably when the proportion of monomer M2 (AA) reaches about 40% (Table V, E5).

In the case of the sample E1 containing little acid functionalized monomer (AA), the poor resistance to corrosion is attributable to an excessively low glass transition temperature (cf. supra).

Influence of the Component "M3"

Table VI shows the influence of the nature of the ethylenically unsaturate monomer (vinyl monomer as a replacement for the methacrylic ester) which enters into the composition of the polymer: the replacement of MMA (E2, E9), with styrene (H1, H2), has no significant influence on the corrosion resistance, or on the friction properties, whether at low levels of oil according to the invention (E2, H2) or at higher levels of oil (E9, H1).

Synergy of the Treatment According to the Invention with Conventional Oil Treatments:

As was indicated above, it is desirable for the protective film applied from the emulsion according to the invention to have not only good intrinsic lubricating properties, but also good lubricating properties in synergy with oils which would be applied on the film, in general oils for working on metals or oils for drawing operations; these oils may be whole oils or soluble oils; the expression whole oil is understood to mean an oil having a homogeneous organic phase, and the expression soluble oil is understood to mean an oil-in-water emulsion.

Table X gives the results of the measurement of the coefficient of friction which are obtained on steel test pieces treated solely with oil, treated solely with an emulsion according to the invention (here: E1), or treated successively with an emulsion according to the invention (here: E1) and then with oil.

In all cases, the treatment with the emulsion according to the invention is suitable to obtain a dry deposit of the order of 2 g/m$^2$ as above, the oil treatment is carried out as follows:
whole oil: application of about 2 g/m$^2$,
soluble oil: application to excess (about 20 g/m$^2$).

The trade name of the oils used is listed in Table X; all the oils tested are reputed to be oils for drawing operations, apart from the oil QUACLAD 80-21 (company QUAKER) which is reputed to be an oil for temporary protection.

According to the results obtained, it is observed that all these oils are perfectly compatible with the treatment with the aid of the emulsion according to the invention, even in the case of the soluble oils: after double treatment (emulsion according to the invention, then oil treatment), the coefficient of friction is less than that which is obtained after treatment with only the emulsion according to the invention.

A synergistic effect is even observed between the two treatments since the tribological properties are essentially better than those which would be obtained following a single treatment, whether this be oil treatment alone or the application of the emulsion according to the invention alone.

In the case of the soluble oils, it might have been feared that the protective film applied using the emulsion according to the invention is not destroyed, for example resolubilized, at the time of application of the oil; it is observed that this is not the case since the coefficient of friction obtained after double treatment is less than that which is obtained after a single treatment with the emulsion.

The compatibility of these oils was also checked with other emulsions, in particular with the abovementioned emulsions A2 and E2 (Table III).

TABLE X

Coefficient of friction: compatibility of the treatment with the emulsion and an oil treatment

| Nature Oil | Type | Oil alone | Emulsion alone | Emulsion + Oil |
|---|---|---|---|---|
| QUAKER 72cc | Soluble | 0.12 | 0.08 | 0.04 |
| CALOTTE 450 | Soluble | 0.18* | 0.08 | 0.06 |
| ANTICORIT V14 | Whole | 0.12 | 0.08 | 0.06 |
| CRODA MM 181 | Whole | 0.15* | 0.08 | 0.05 |
| QUACLAD 80-21 | Whole | 0.15 | 0.08 | 0.06 |

*Chattering

Influence of Various Corrosion Inhibitors

To the emulsion E"2 (mechanical stirring), there are added:

10 g/l of only one of the inhibitors in Table II-2, or 10 g/l of one of the inhibitors in Table II-2 and 10 g/l of another inhibitor in this table.

During the tests of performances of these additivated emulsions, it was observed that the addition of inhibitor made it possible to improve the corrosion resistance but could have a very damaging effect on the tribological properties.

Among the emulsions tested, the one which is additivated with 10 g/l BBA and 10 g/l S379 (abbreviations: cf. Tab.II-2) exhibits a good compromise between the lubricating properties and the anticorrosion properties.

Influence of the Component "M1" in the Presence of Corrosion Inhibitors

Starting with two different organic phases (see Table III) E2 and J1, stirred mechanically and both containing 2.5% of paraffin oil, emulsions according to the invention are prepared by additivating them based on the previously defined optimum of 10 g/l BBA and 10 g/l S379.

The performances obtained are reported in Table XI below.

TABLE XI

Influence of "M1" for additivated emulsions:

| Samples: | Additivated E2" | Additivated $E2^{IV}$ | J1 (additivated) |
|---|---|---|---|
| Cosolvent: | ethanol | PEG 200 | PEG 200 |
| Quantity: | 75 ml | 30 ml | 30 ml |
| Friction (coef. at 1800 daN) | 0.13 | 0.10 | 0.06 |
| Hot-wet test (number of cycles before score 1) | 28 | 15 | 18 |
| Transport test: score: | 0 | 0.25 | 0.25 |
| Cleanability | 100% | 100% | 100% |
| Glass transition $T_g$: | | | 0 to 5° C. |

By comparing with the results of Table IX where the emulsions are not additivated, it can be confirmed that the additivation of the emulsions according to the invention makes it possible to very substantially improve the corrosion resistance while limiting the degradation of the tribological properties; in all cases, the films obtained have a dry appearance.

Uses of the Sheet Metals Treated using the Emulsion According to the Invention For some applications, such as enameling or painting, it has been observed that it is not necessary to remove or "clean" this film before applying the layer of enamel or that of paint; in this case, formulations which lead to noncleanable films are preferably used and the emulsions according to the invention which are not easy to clean then find an advantageous outlet.

For painting, it is therefore advisable for the emulsion film to be sufficiently thin, for example between 0.5 and 1 g/m$^2$ in the dry state.

For enameling, higher surface densities, for example between 2 and 3 g/m$^2$, may be used because the film will be removed during the enamel firing stage which will be typically performed at around 850° C.

What is claimed is:

1. A process for preparing an aqueous emulsion of polymer for the treatment of a metal surface, comprising the steps of:

preparing an organic mixture comprising monomers of said polymer and a free radical polymerization initiator, said monomers comprising at least one monomer M1, chosen from the group consisting of acrylic acid esters and methacrylic acid esters, and at least one acrylic or methacrylic monomer M2 having an acid, amide, amine or epoxy group, the monomers M1 and M2 representing at least 30% of the total weight of the organic mixture and the at least one monomer M2 representing less than 25% of the total weight of the organic mixture, in an aqueous phase containing a surfactant suitable for emulsification, miniemulsifying said organic mixture to form colloids of said mixture, copolymerizing said monomers in a miniemulsion by activation of the initiator, characterized in that:

said organic mixture also comprises at least 0.1% by weight of oil, the miniemulsion is prepared in the presence of at least one cosolvent added in a quantity representing at least 0.7% by weight relative to the total weight of the organic mixture and the aqueous phase.

2. The process as claimed in claim 1, characterized in that said cosolvent is a polyalkylene glycol.

3. The process as claimed in either of claims 1 and 2, characterized in that the proportion of oil in said organic mixture remains sufficiently low for the oil to be practically completely integrated into the colloids of monomer mixture.

4. The process as claimed in claim 1 or 2, characterized in that the proportion of oil in said organic mixture remains sufficiently low for a single population of colloid size to be obtained.

5. The process as claimed in claim 1 or 2, characterized in that the proportion of oil in said organic mixture is less than 5%.

6. The process as claimed in claim 1 or 2, characterized in that the proportion of oil in said organic mixture is greater than or equal to 1%.

7. The process as claimed in claim 1 or 2, characterized in that said oil is a paraffin oil.

8. The process as claimed in claim 2, characterized in that said polyalkylene glycol is a polyethylene glycol.

9. The process as claimed in claim 1 or 2, characterized in that the monomer M1 is chosen from the group consisting of n-propyl acrylate, isobutyl acrylate, n-butyl acrylate (BuA), sec-butyl acrylate, tert-butyl acrylate, n-hexyl acrylate, lauryl acrylate, methyl methacrylate (MMA), ethyl methacrylate, n-butyl methacrylate, isobutyl methacrylate, sec-butyl methacrylate, tert-butyl methacrylate, n-hexyl methacrylate, cyclohexyl methacrylate, ethylhexyl methacrylate, and lauryl methacrylate.

10. The process as claimed in claim 1 or 2, characterized in that said monomers also comprise at least one ethylenically unsaturated copolymerizable monomer M3 other than an acrylic acid ester and a methacrylic acid ester.

11. The process as claimed in claim 10, characterized in that the monomer M3 is chosen from vinyl monomers.

12. The process as claimed in claim 1 or 2, characterized in that the proportion of the various monomers in said mixture is adjusted so as to obtain a polymer whose glass transition temperature Tg is such that: $-40° C. < Tg \leqq +20° C.$

13. The process as claimed in claim 1 or 2, characterized in that the monomer M2 has an acid group.

14. The process as claimed in claim 13, characterized in that the monomer M2 is chosen from the group consisting of acrylic acid, methacrylic acid, itaconic acid, maleic acid and fumaric acid.

15. The process as claimed in claim 14, characterized in that the monomer M2 is acrylic acid.

16. The process as claimed in claim 13, characterized in that the at least one monomer M1 is chosen from the group consisting of n-butyl acrylate (BuA) and methyl methacrylate (MMA).

17. The process as claimed in claim 13, characterized in that the at least one monomer M1 is chosen from the group consisting of lauryl acrylate (LA) and 2-ethylhexyl methacrylate (EHMA).

18. An aqueous emulsion for treating a metal surface, which can be obtained by the process as claimed in claim 1, said emulsion comprising an aqueous phase and colloids based on polymer, monomeric units of said polymer comprising at least one monomer M1, chosen from the group consisting of acrylic acid esters and methacrylic acid esters and at least one acrylic or methacrylic monomer M2 having an acid, amide or amine group, the monomers M1 and M2 representing at least 30% of the total weight of said polymer and the at least one monomer M2 representing less than 25% of the total weight of said polymer, characterized in that:

said emulsion contains at least 0.7% by weight of at least one cosolvent other than water, said colloids contain at least 0.1% by weight of oil, and the average size of said colloids is less than 1000 nm.

19. The emulsion as claimed in claim 18, characterized in that the proportion of oil relative to the weight of said polymer is greater than or equal to 1% and less than 5%.

20. The emulsion as claimed in either of claims 18 and 19, characterized in that said monomers also comprise at least one ethylenically unsaturated copolymerizable monomer M3 other than an acrylic acid ester and a methacrylic acid ester.

21. The emulsion as claimed in claim 18 or 19, characterized in that the glass transition temperature $T_g$ of said polymer is such that: $-40°\ C. < Tg \leqq +20°\ C.$

22. A process for protecting against corrosion of a metal surface comprising the steps of:

applying to said surface an aqueous emulsion as claimed in claim 18, drying the applied emulsion so as to obtain a protective film, characterized in that the surface density of said dried film is between 0.5 and 6 $g/m^2$.

23. The process as claimed in claim 22, characterized in that said emulsion contains corrosion inhibitors.

24. The process as claimed in claim 23, characterized in that said metal surface is a steel surface.

25. A process for drawing sheet metal comprising the steps of:

applying on said sheet metal an aqueous emulsion as claimed in claim 18, drying the applied emulsion so as to obtain a lubricating film, and actually drawing said sheet metal, characterized in that the surface density of said dried film is between 0.5 and 5 $g/m^2$.

26. The process as claimed in claim 25, characterized in that said cosolvent is a polyalkylene glycol.

27. The process as claimed in claim 26, characterized in that said process comprises, before drawing, a step of oiling said sheet metal provided with said dried film.

28. The process as claimed in claim 27, characterized in that said oiling step is carried out with the aid of an aqueous emulsion of oil.

* * * * *

UNITED STATES PATENT AND TRADEMARK OFFICE

CERTIFICATE OF CORRECTION

PATENT NO. : 6,458,887 B1
DATED : October 1, 2002
INVENTOR(S) : Philippe Legros et al.

It is certified that error appears in the above-identified patent and that said Letters Patent is hereby corrected as shown below:

Title page,
Item [73], should read:
-- (73) Assignee: USINOR, Puteaux (FR) --

Signed and Sealed this

Twenty-ninth Day of July, 2003

JAMES E. ROGAN
*Director of the United States Patent and Trademark Office*